US007596918B2

(12) United States Patent
Hills

(10) Patent No.: US 7,596,918 B2
(45) Date of Patent: Oct. 6, 2009

(54) BUILDING APPARATUS FOR FORMING A WALL CONSTRUCTION AND METHOD FOR FORMING A WALL USING THE APPARATUS

(76) Inventor: Danny W. Hills, 3 Dandenong-Hastings Road, Tyabb, Victoria (AU)

( * ) Notice: Subject to any disclaimer, the term of this patent is extended or adjusted under 35 U.S.C. 154(b) by 684 days.

(21) Appl. No.: 10/493,311

(22) PCT Filed: Nov. 4, 2002

(86) PCT No.: PCT/AU02/01507

§ 371 (c)(1),
(2), (4) Date: Oct. 18, 2004

(87) PCT Pub. No.: WO03/040487

PCT Pub. Date: May 15, 2003

(65) Prior Publication Data

US 2005/0050838 A1 Mar. 10, 2005

(30) Foreign Application Priority Data

Nov. 3, 2001 (AU) ..... PR8756

(51) Int. Cl.

| | |
|---|---|
| ***E04B 1/16*** | (2006.01) |
| ***E04B 1/20*** | (2006.01) |
| ***E04B 5/18*** | (2006.01) |
| ***E04B 9/00*** | (2006.01) |
| ***E04C 2/42*** | (2006.01) |
| ***E04C 5/04*** | (2006.01) |
| ***E04C 2/54*** | (2006.01) |
| ***E04C 2/32*** | (2006.01) |
| ***E04F 13/04*** | (2006.01) |
| ***E04F 15/06*** | (2006.01) |
| ***E04F 19/10*** | (2006.01) |

(52) U.S. Cl. ..... 52/336; 52/333; 52/340; 52/450; 52/674; 52/783.11

(58) Field of Classification Search ..... 52/319, 52/322, 323, 333, 336, 340, 344, 414, 443, 52/649.1, 671, 674, 783.11, 785.17, 785.18, 52/785.19, 503, 603, 606
See application file for complete search history.

(56) References Cited

U.S. PATENT DOCUMENTS 4,788,809 A * 12/1988 Koukourou ..... 52/741.15
5,465,542 A * 11/1995 Terry ..... 52/309.7
5,465,545 A 11/1995 Trousilek (Continued)

FOREIGN PATENT DOCUMENTS

AU 5788069 1/1971

(Continued)

*Primary Examiner*—Brian E Glessner
*Assistant Examiner*—Branon C Painter
(74) *Attorney, Agent, or Firm*—Dennison, Schultz & Macdonald

(57) ABSTRACT

A method of constructing a wall of a building by casting in which formwork is erected and concrete is allowed to exude through perforations in the formwork, embedding the formwork in concrete and obscuring it from view. A panel for carrying out the method, a thin-walled sheet with multiple perforations for the escape of the concrete during casting, has brackets or clips to fasten it to the adjacent formwork creating a casting space between the panel and the supporting formwork. Floating the expressed concrete produces a smooth finish.

27 Claims, 8 Drawing Sheets

U.S. PATENT DOCUMENTS

| | | | | | |
|---|---|---|---|---|---|
| 5,528,876 | A | * | 6/1996 | Lu | 52/654.1 |
| 5,579,620 | A | * | 12/1996 | Kuo | 52/447 |
| 5,611,183 | A | | 3/1997 | Kim | |
| 5,729,944 | A | | 3/1998 | De Zen | |
| 5,802,795 | A | * | 9/1998 | Myers et al. | 52/426 |
| 5,809,725 | A | * | 9/1998 | Cretti | 52/426 |
| 5,906,081 | A | * | 5/1999 | Mantyla | 52/344 |
| 6,085,480 | A | * | 7/2000 | Baldwin | 52/612 |
| 6,151,854 | A | * | 11/2000 | Gutjahr | 52/385 |
| 6,173,937 | B1 | * | 1/2001 | Cottongim | 249/40 |
| 6,212,845 | B1 | | 4/2001 | De Zen | |

FOREIGN PATENT DOCUMENTS

| | | |
|---|---|---|
| FR | 2710676 | 4/1995 |
| FR | 2800109 | 4/2001 |
| WO | 93/21403 | 10/1993 |
| WO | 9321403 | 10/1993 |
| WO | 9512714 | 5/1995 |
| WO | 95/33106 | 12/1995 |
| WO | 96/35024 | 11/1996 |

* cited by examiner

BUILDING APPARATUS FOR FORMING A WALL CONSTRUCTION AND METHOD FOR FORMING A WALL USING THE APPARATUS

This application is a filing under 35 Usc 371 of PCT/AU02/01507 filed Nov. 4, 2002.

FIELD OF THE INVENTION

This invention concerns a method of constructing walls, moulds for the same and buildings when constructed with such walls.

BACKGROUND OF THE INVENTION

The use of shuttering and formwork to create moulds for concrete buildings includes the step of removing the moulds so that the surface of the concrete is exposed and the mould is reusable. Recovering of the moulds imposes upon the builder the need to dismantle the formwork and to accept the surface finish left by the mould. It could be coloured and/or rendered, but the technique is thereby limited.

SUMMARY OF THE INVENTION

One apparatus aspect of the invention provides a wall of a building comprising courses of repeating spacer elements, the spacer elements together defining a core, a panel mould lying adjacent the face of the spacer, the space between the face of the spacer, and the wall of the mould being intended for filling with a fluent hardenable construction mix, the panel wall being perforated to permit the fluent mix to extrude and form a hardened layer outside the panel wall obscuring it from view.

The spacers may be closed at top and bottom and both ends, all the faces being impervious and resembling a closed box. The spacers may have means to support a lattice of reinforcement, such as rods. Full and half spacers may be provided to permit bonded courses to be built. When the spacers are assembled to form a matrix, they define multiple passages connecting the inner array of moulds with the outer array of moulds which fill with mix during construction and permanently join the two cast leaves of the wall.

The panels may include spaces whose edges define the openings of the wall, eg. doors and windows. The spacers may be hollow like a matrix of boxes. Alternatively, the spacers may be solid. Expanded polymer bead products, such as polystyrene bead material and closed cell foams are useful. The panels may be moulded, thermoformed or pressed from metal sheet.

The inner panel faces may be contoured so that the expressed mix forms covings and skirtings and other internal features of the building. The spacers may have ends which when assembled in courses, define the multiple passages connecting the outer array of panels with the inner array of panels. The term 'panel' is not restricted to a two dimensional structure which produces a planar wall. Curvilinear shapes are possible by manufacturing the panel in the required shape.

The outer face of the panel, that is the face defining the perimeter of the wall, namely the outside face and the inner face of the panel which defines the inner face of the building, are perforated and may also be corrugated or dimpled or otherwise arranged to accommodate different depths of mix in order to improve the float response of the wall.

Conventional reinforcement, such as required by building regulations, is included in the wall, for example rods and bars which are wired, welded or clipped together. The term 'perforations' includes slots. Circular perforations are useful. The diameter is not critical in that the quantity of mix which flows through the perforations depends on the composition of the mix, for example the aggregate size and the water content. Diameter of 5-15 mm have given useful results.

The corrugations on the panel are not essential in that acceptable results are attainable using flat panels, however the floating operation tends to push aggregate with the floor of corrugation and a smoother finish is achieved.

DETAILED DESCRIPTION WITH RESPECT TO THE DRAWINGS

Figure 1:
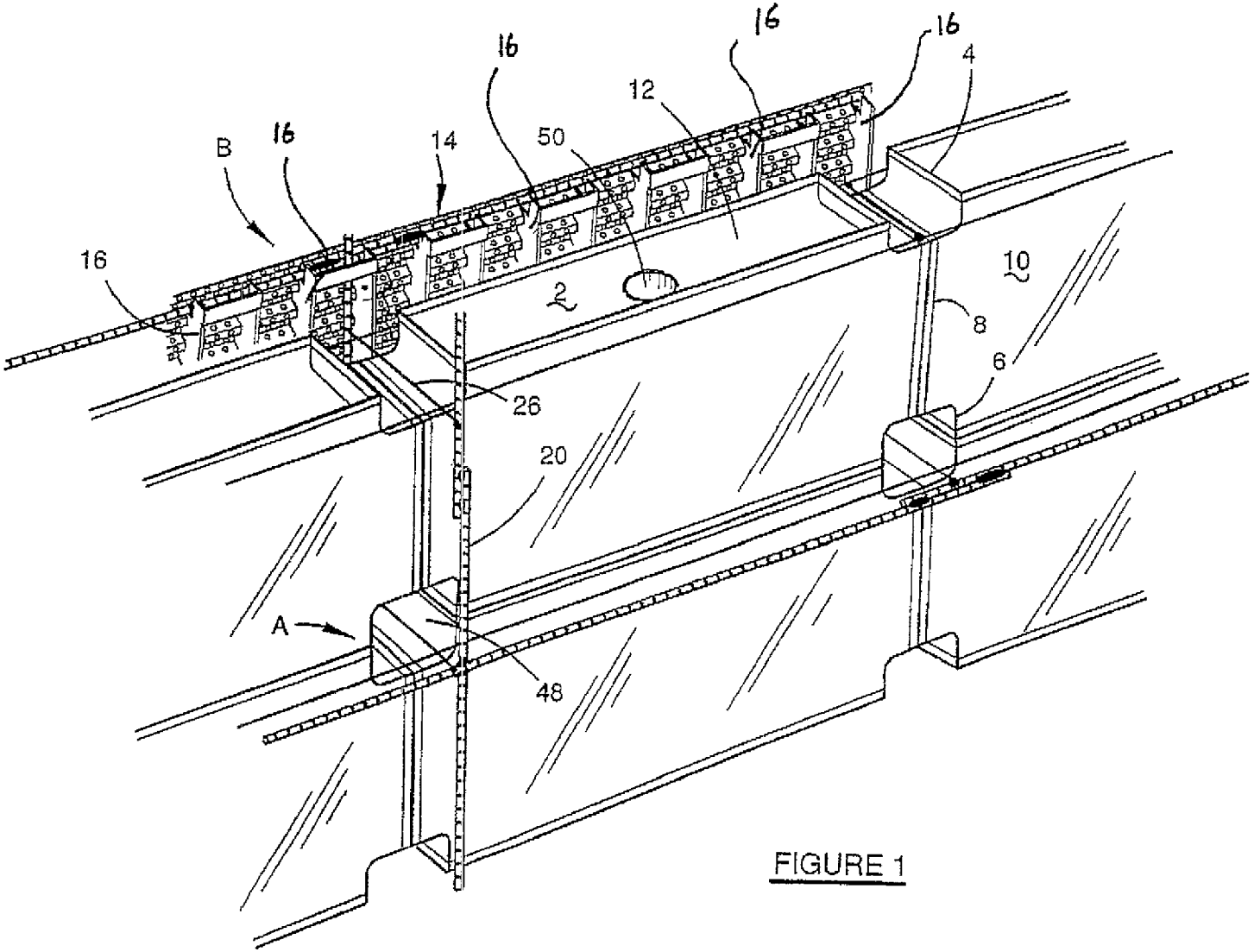
FIG. 1 is a perspective view of a representative wall portion part way through construction.
Figure 2:
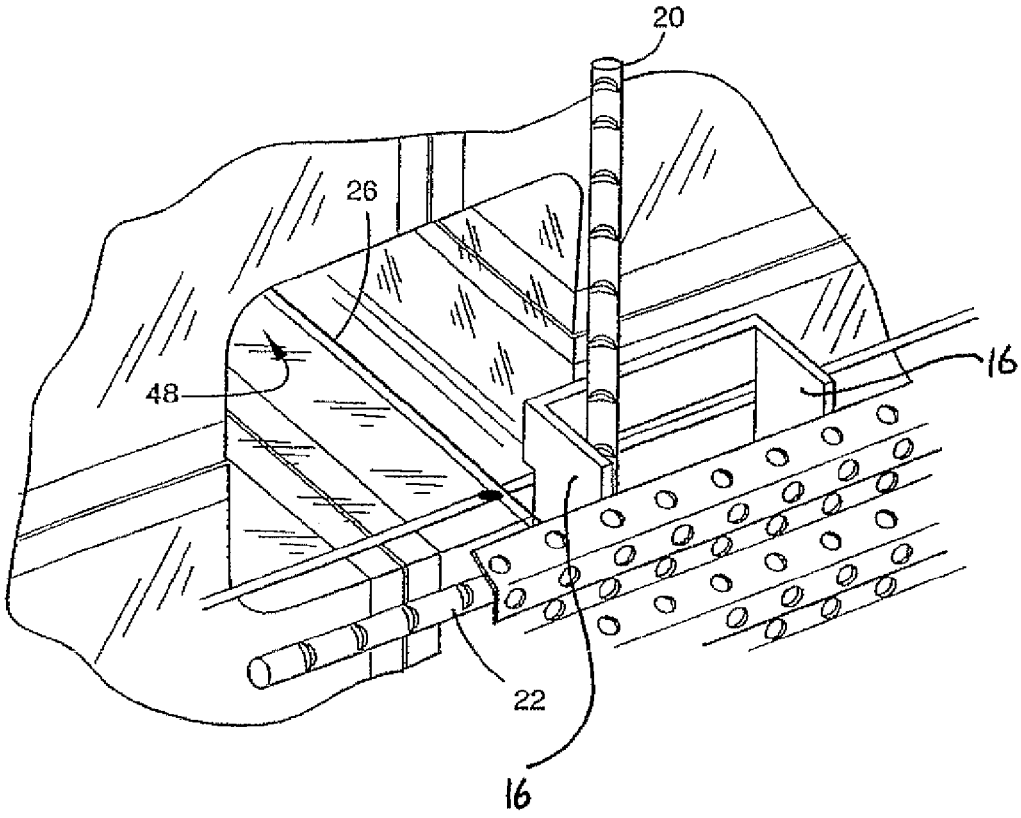
FIG. 2 is an enlargement of the area marked A of FIG. 1 seen from direction B.
Figure 3:
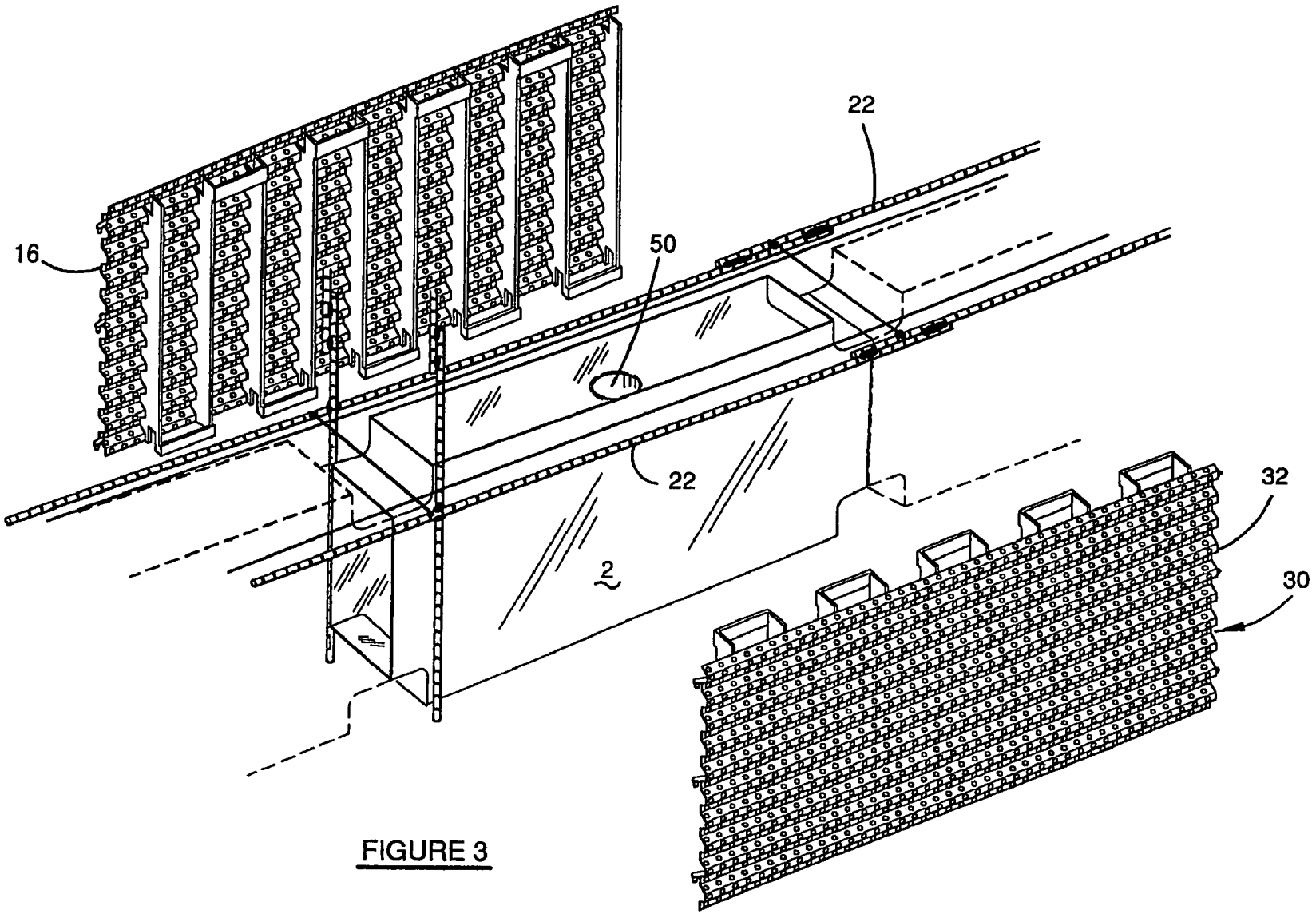
FIG. 3 is an exploded view of the wall portion shown in FIG. 1 with a pair of opposed panels.

Referring to FIGS. 1, 2 and 3, a box-like spacer 2 is blow moulded from recycled plastic (600×300×65 mm). Each has a rectangular horizontal upper flange 4, a rectangular horizontal lower flange 6, a rectangular end flange 8 (one shown), an upstanding inner face 10 and an upstanding outer face 12. Accordingly the spacer is closed at the top and bottom and both ends.

Figure 7:
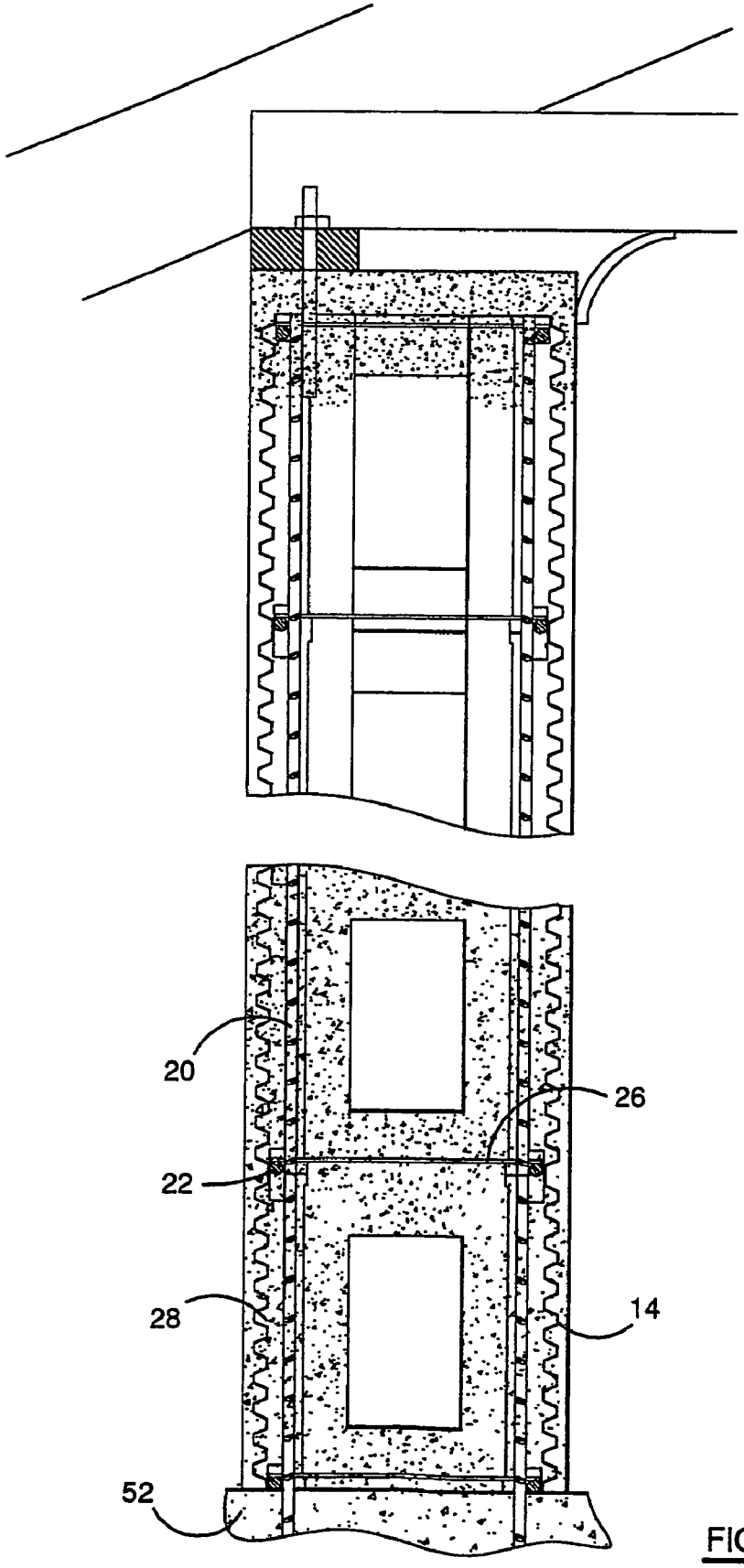
FIG. 7 is a section through the completed wall.

The face 12 is impervious and together with adjoining spacers form a composite vertical mould face which cooperates with an array of panel moulds 14. The ribs 16 abut the spacer face 12. The ribs 16 of the panels have cradles 18 for supporting horizontal reinforcing rods 20. Vertical reinforcement rods 20 lie adjacent ribs at the end of each panel. Linking wires 26 join the rods associated with the inner panel 14 and the cuter panel 28 (FIG. 7). The panels are injection mouldings with a sheet thickness of 1 mm.

Figure 4:
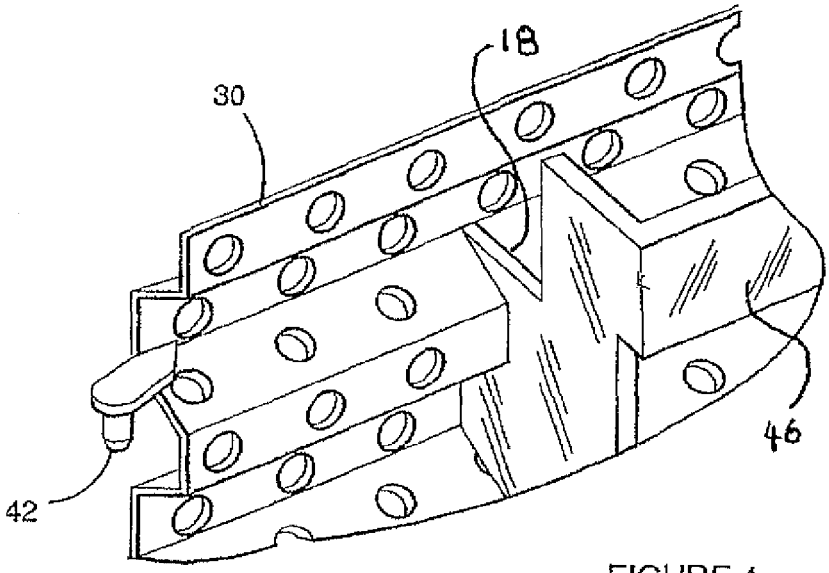
FIG. 4 is a close up of an edge fragment of a panel showing the peg locator.
Figure 5:
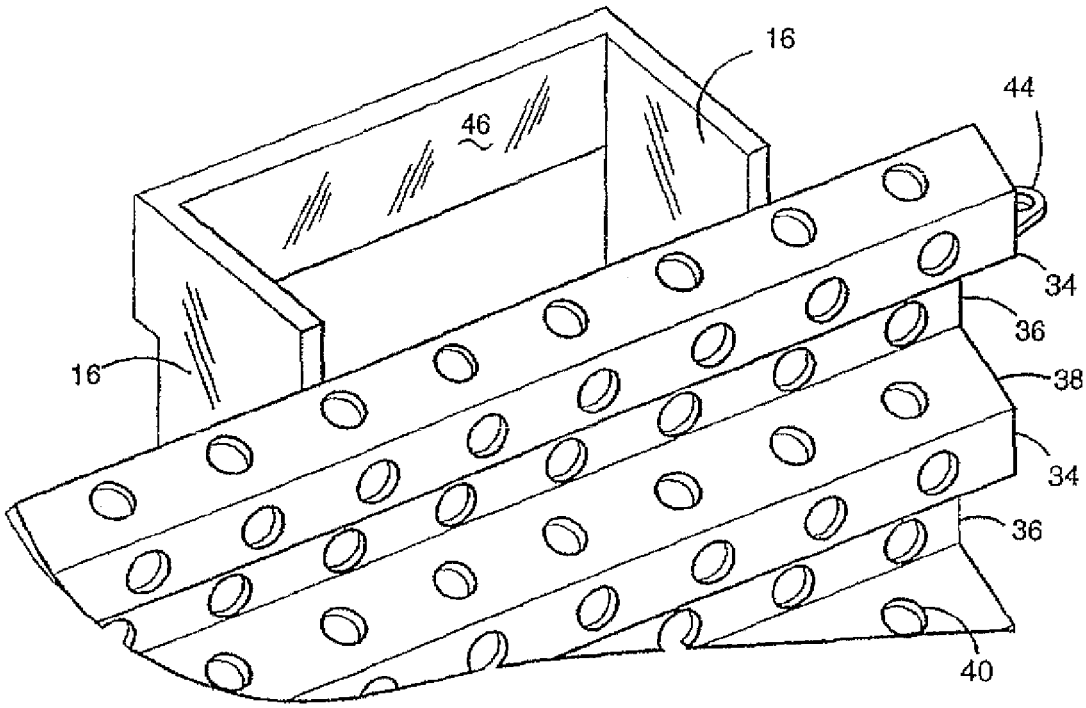
FIG. 5 is a close up of the corresponding edge portion of an adjacent panel showing the eye which receives the peg.

Referring now to FIGS. 4 and 5, the exposed panel face 30 has corrugations 32 made up of flat crests 34, flat floors 36 and inclined margins 38. Rows of apertures 40 each 8 mm in diameter allow concrete to be expressed when the panel moulds are filled.

One end of each panel has a pair of pins 42 (one shown) and a pair of eyes 44 (one shown). The pins and eyes interengage and keep the panel array coplanar. Cradles 18 and the bridges 46 which span a pair of ribs 16 are seen more clean in FIGS. 4 and 5. The bridges together with the corrugated face 30 create guideways for the vertical bars 20.

Figure 6:
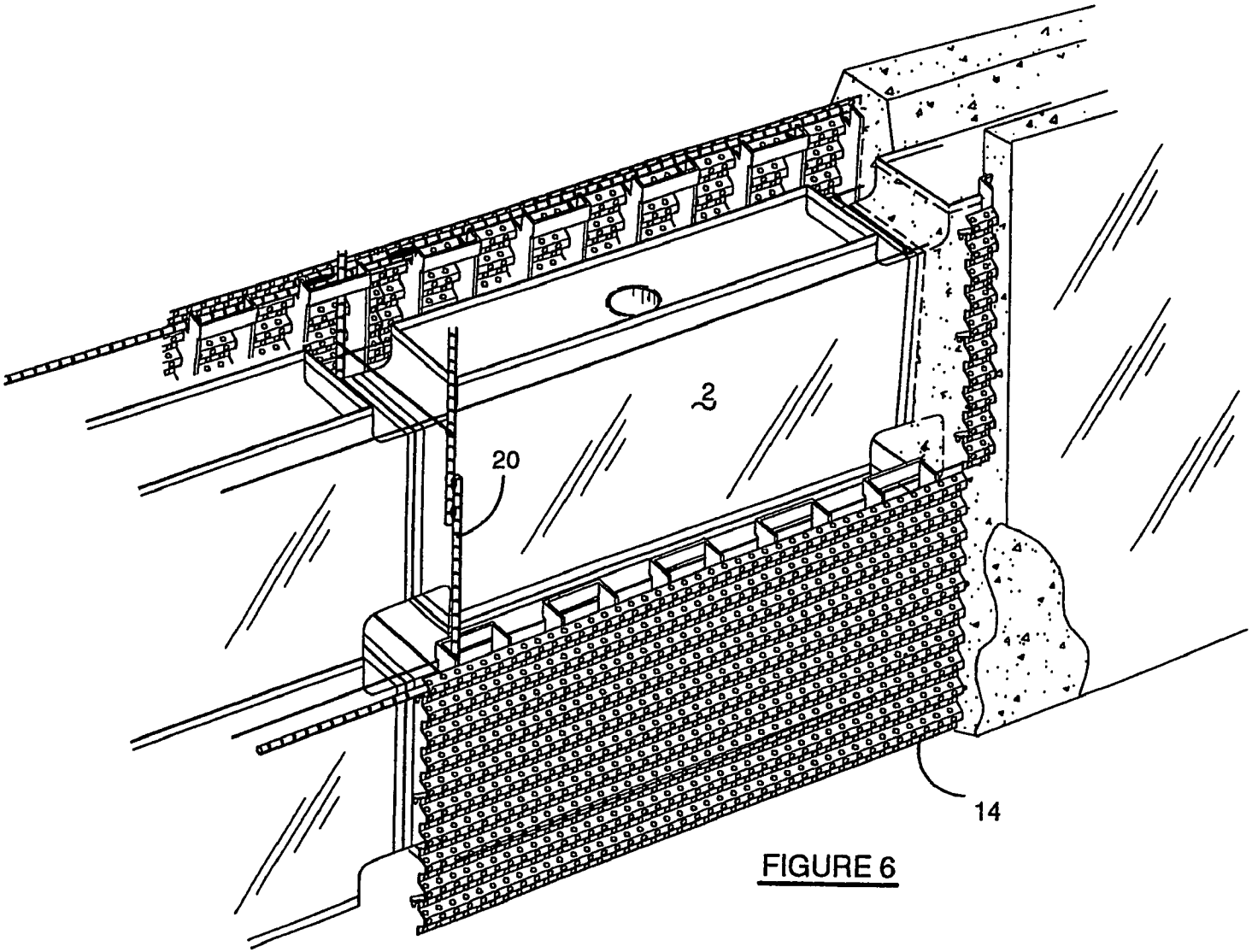
FIG. 6 is a perspective as in FIG. 1, showing part of the wall after casting.

The spacers are laid in courses with the bottom flange overlying the top flange of the course beneath. The spacers thus form a matrix in which the abutting ends form passages 48 passing through the wall and interconnecting the inner and outer panel moulds. The spacers have a moulded vertical services tunnel 50 which registers with the tunnels in courses above and below. Service conduits ascend and descend in this way. Alternatively, there is room in the casting space. Apertures are cut in the panel to allow connection to service outlets in the room. In FIG. 6, the final cast appearance of the wall is shown. In FIG. 7, the wall is shown erected on a standard footing 52. All the spacers, moulds and reinforcements are embedded by the cast concrete.

Figure 8:
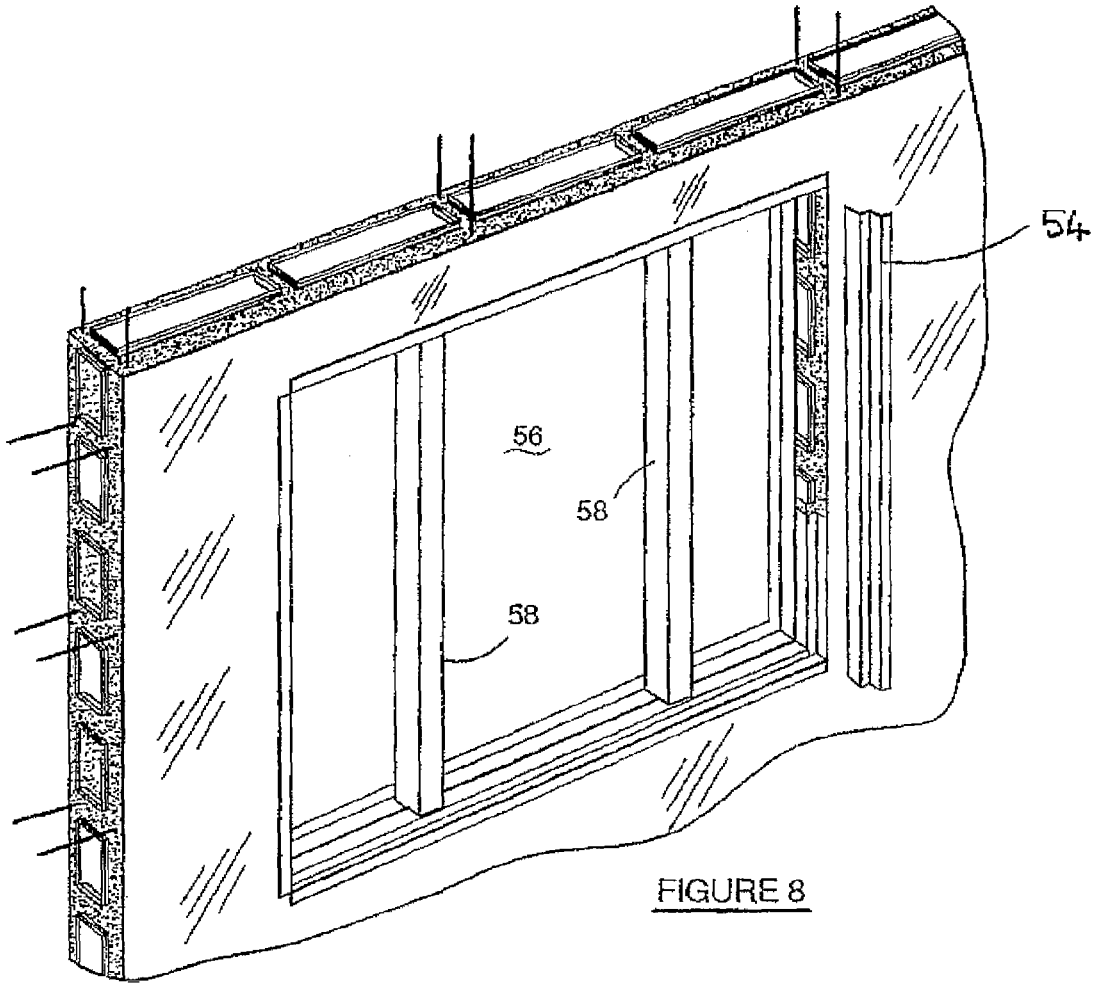
FIG. 8 is a perspective of a wall containing a window with the moulds for the window surround propped in position for casting.
Figure 9:
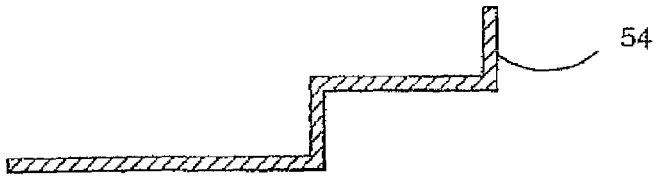
FIG. 9 is a section of the mould in FIG. 8.

In FIG. 8, the panels have mould extensions 54 fitted in two halves which allow the mix to form the headers, styles and sill of a window. These are fixed in the opening 56 by props 58. The mould in FIG. 9 is a split mould responsible for half the window edge profile. Mould extensions for interior features such as coving and skirtings are formed in like manner. A profiled float is used to follow the extension profile. Extension features, such as parapets, cappings, column capitals and similar ornament are attainable.

Figure 10:
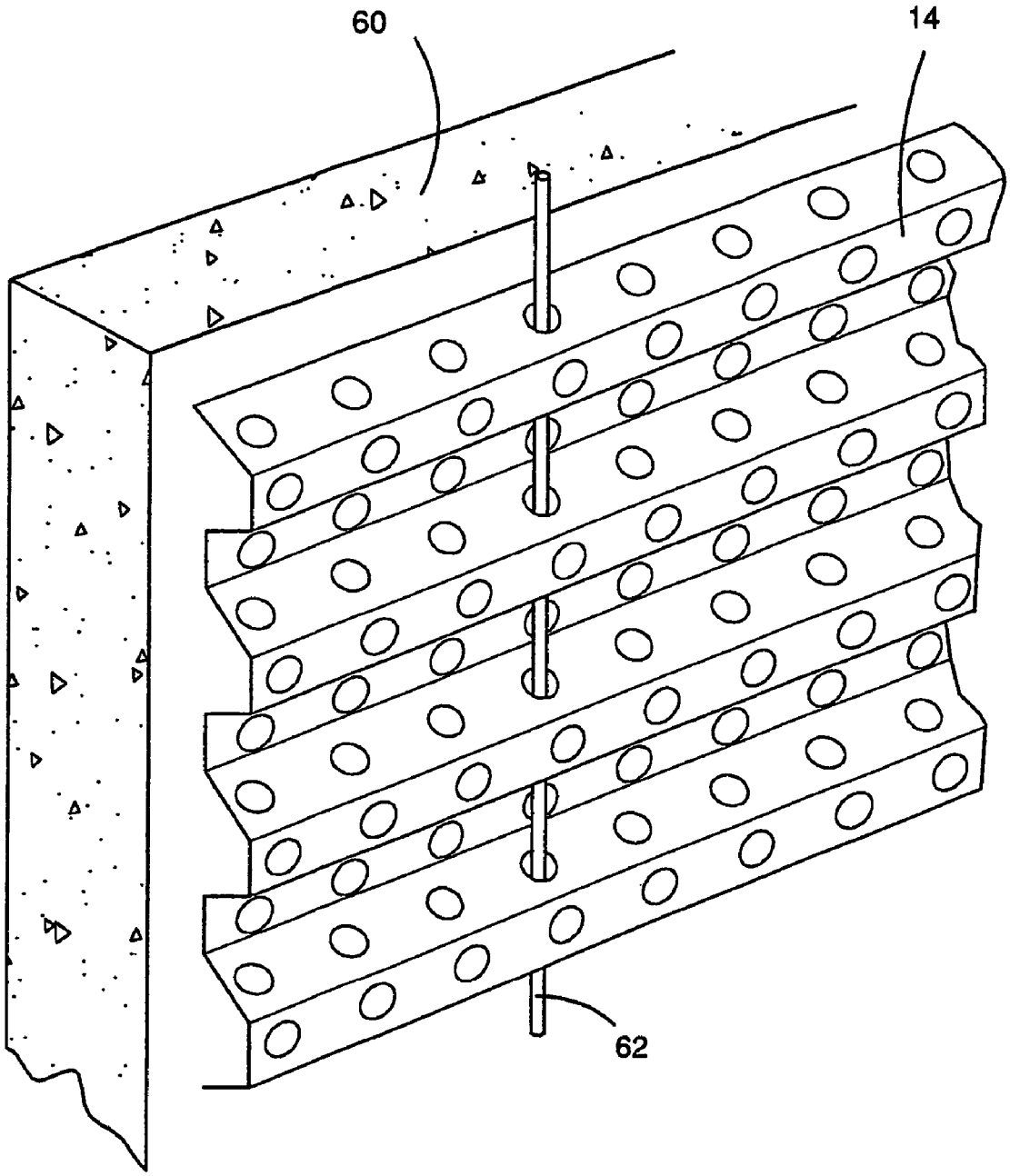
FIG. 10 is a perspective of a fragment of a wall showing part conventional construction using casting panels.

In FIG. 10, slab 60 is a 2700×1200×75 mm aerated concrete slab sold under the trade mark HEBEL POWERPANEL. The panel 14 is extruded and then perforated with some perforations being vertically aligned to take thin rods 62.

The order of construction is as follows:

Footings are built conventionally with trench mesh, such that pairs of 1200 mm bars project at 220×600 spacings.

Initial courses of spacers 2 are then laid between the bars to a height of 1200 mm. Panels 14 are threaded on to the bars and slid down so that the ribs touch the spacers. The edges of the panels interfit. Horizontal bars 22 are laid in the panel cradles 18 and the vertical bars 20 are extended. The bars are wired together and linking wires 26 are inserted through the passages 48.

The next series of panels are threaded on the extended bars up to the first storey height of 2700 mm. Service conduits are inserted to mate with gaps inserted opposite the positions of outlets in the room of which the wall is a part. Water and electrical services are completed.

If the building is single storey, the structure is ready to pour. A concrete pump attends the site. The filler pipe of the concrete pump is bifurcated so as to direct flow into the casting spaces on both sides of the spacers. The building may be multistorey utilising the same methodology.

Concrete rises in the structure and flows into the passages, thereby joining the two leaves of the wall. As the weight of the concrete increases, the lower panels lose mix through the perforations. The panels express about 20 mm of concrete and floating operation commences. Once the float passes across the panel, the concrete loses it stippled appearance and expression ceases. The water content of the exterior changes and the smoothing operation can begin. The passages 48 through the wall thickness allow in situ bridges between the leaves of the wall and the moulds become entirely hidden by floated concrete. Any texturing or finishing process such as embedding grit now occurs. The pump then adds concrete on top to form the next storey. When the concrete dries, a colour such an acrylic coating is applied.

We have found the advantages of the above embodiments to be:

1. The moulds remain in the structure permanently.
2. Float material flows freely from the wall, obviating the need to apply render.
3. Trade skill at a minor level suffices.
4. Free forms, including curvilinear are attainable. Instead of or in addition to floating, patterning of devices can be present with the expressed concrete.

It is to be understood that the word "comprising" as used throughout the specification is to be interpreted in its inclusive form, ie. use of the word "comprising" does not exclude the addition of other elements.

It is to be understood that various modifications of and/or additions to the invention can be made without departing from the basic nature of the invention. These modifications and/or additions are therefore considered to fall within the scope of the invention.

The claims defining the invention are as follows:

1. A building apparatus for forming, moulding and rendering a wall construction comprising at least one permeable panel and means for fitting the at least one panel to supporting elements of a wall at a distance removed therefrom to provide an uppermost cavity constructed and arranged for filling with a wall-forming filler between the supporting elements and said at least one panel, said at least one panel comprising a plurality of apertures having a size enabling the filler to pass uniformly therethrough, such that, once rendered and set, the rendered filler and said panels form an integral part of the wall, with the filler passing through the apertures forming an outer surface of the wall, wherein said panels have an outer skin and a plurality of parallel inner supporting ribs over the substantial length of said panel, and said outer skin is formed with a series of substantially parallel corrugations transverse to the direction of said supporting ribs.

2. An apparatus according to claim 1, wherein said inner supporting ribs form a casting space or conduit to assist in directing and controlling the flow of the filler in the cavity.

3. An apparatus according to claim 1 wherein said apertures are formed in a substantially uniform array over a substantial area of an outer skin of said at least one panel.

4. An apparatus according to claim 1, wherein the corrugations are defined by flat crests, flat floors and inclined margins, and said apertures are formed in linear rows along the flat crests and inclined margins of said corrugations.

5. An apparatus according to claim 1, wherein adjacent ribs are joined by a bridge.

6. An apparatus according to claim 5, wherein when adjacent panels are interengaged, a continuous bridge is formed across first and second ends of said ribs.

7. An apparatus according to claim 5, wherein a first edge of the skin of said panel has at least one pin and a second edge of said skin has at least one corresponding eye, wherein said at least one pin and said at least one eye of adjacent panels can cooperate for interengagement in a second direction.

8. An apparatus according to claim 1, wherein said supporting elements comprise spacer blocks having a sealable cavity.

9. An apparatus according to claim 8 wherein said spacer blocks are parallelepiped.

10. An apparatus according to claim 8, wherein said spacer blocks include steps formed at the corners thereof to define upper and lower flanges which in turn define mating faces for said spacer blocks having hollow transverse passages formed at the juncture of four mating blocks.

11. An apparatus according to claim 8 wherein said spacer blocks include integral traversing conduits to act as service tunnels.

12. An apparatus according to claim 1, wherein said panels are constructed of metal.

13. An apparatus according to claim 1, wherein said panels are constructed of a plastic mouldable material.

14. A method of constructing a wall using a building apparatus for forming, moulding, and rendering a wall construction comprising at least one permeable panel and means for fitting the at least one panel to supporting elements of a wall at a distance removed therefrom to provide an uppermost cavity constructed and arranged for filling with a wall-forming filler between the supporting elements and said at least one panel, said at least one panel comprising a plurality of apertures having a size enabling the filler to pass uniformly therethrough, such that, once rendered and set, the rendered filler and said panels form an integral part of the wall, with the filler passing through the apertures forming an outer surface of the wall, said method comprising the steps of:

a) securing the permeable panel or panels to a surface capable of supporting said panels;

b) filling the cavity formed between said panels and said supporting surface with a filler such that said filler permeates through the apertures of said panels;

c) smoothing or rendering the permeated filler with a finishing tool while said filler is in a workable state; and d) allowing the rendered filler to set.

15. A method according to claim 14, wherein said supporting wall includes a plurality of assembled spacer blocks having inner and/or outer faces adapted to form said supporting surface.

16. A method according to claim 14 wherein said assembled spacer blocks are fitted with horizontal reinforcement bars adapted to engage said panels and hold same against said supporting wall.

17. A method according to claim 16 wherein the panels have ribs with a bridge extending between adjacent ribs, and vertical reinforcement bars are fitted between said ribs so as to bear against bridges spanning adjacent ribs as said panel is drawn into contact with said supporting wall.

18. A method according to claim 17 where linking wires are fitted between corresponding reinforcing rods fitted to either side of said supporting wall.

19. A method according to claim 18, wherein said filler is placed into said cavity at a suitable rate to allow a position of said filler to permeate through said apertures in the skin of the panel.

20. A method according to claim 19, wherein said filler is placed at a rate allowing the first placement to be rendered and begin to set such that subsequent placement builds on the previous placement to form a wave of workable render permeating through said panel skin.

21. A wall constructed using a building apparatus for forming, moulding, and rendering a wall construction comprising at least one permeable panel and means for fitting the at least one panel to supporting elements of a wall at a distance removed therefrom to provide an uppermost cavity constructed and arranged for filling with a wall-forming filler between the supporting elements and said at least one panel, said at least one panel comprising a plurality of apertures having a size enabling the filler to pass uniformly therethrough, such that, once rendered and set, the rendered filler and said panels form an integral part of the wall, with the filler passing through the apertures forming an outer surface of the wall, wherein the wall is constructed by the steps comprising:

a) securing the permeable panel or panels to a surface capable of supporting said panels;

b) filling the cavity formed between said panels and said supporting surface with a filler such that said filler permeates through the apertures of said panels;

c) smoothing or rendering the permeated filler with a finishing tool while said filler is in a workable state; and d) allowing the rendered filler to set.

22. A wall constructed according to claim 21 comprising a plurality of spacer blocks assembled to form a pre-wall of supporting elements providing at least one supporting surface, a plurality of permeable panels secured to said supporting surface and filler encasing said panels and abutting said supporting surface.

23. A wall according to claim 22, wherein said filler permeates said spacer blocks at the hollow transverse passages formed at the juncture of form mating blocks.

24. A wall according to claim 21 wherein permeable panels and filler are fitted to both sides of said spacer blocks.

25. A wall according to claim 21 wherein said wall is a vertical structure.

26. A wall according to claim 21 wherein said wall is a non-vertical structure.

27. A wall according to claim 26 wherein said structure is horizontal.

* * * * *